United States Patent [19]

Azar et al.

[11] 4,299,899

[45] Nov. 10, 1981

[54] TONER ADDITIVES

[75] Inventors: Jack C. Azar, Rochester, N.Y.; Russel E. Wellman, Southbury, Conn.

[73] Assignee: Xerox Corporation, Stamford, Conn.

[21] Appl. No.: 126,785

[22] Filed: Mar. 3, 1980

Related U.S. Application Data

[62] Division of Ser. No. 958,911, Nov. 8, 1978.

[51] Int. Cl.[3] ..... G08G 9/02

[52] U.S. Cl. ..... 430/108; 430/110; 260/31.2 XA; 260/31.8 R

[58] Field of Search ..... 430/110, 108; 260/31.8 R, 31.2, 31.8 XA

[56] References Cited

U.S. PATENT DOCUMENTS

| | | | |
|---|---|---|---|
| 2,331,265 | 10/1943 | Coleman et al. | 560/255 |
| 2,359,622 | 10/1944 | Coleman et al. | 560/255 |
| 3,577,345 | 5/1971 | Jocknow et al. | 252/62.1 |
| 3,983,045 | 9/1976 | Jugle et al. | 430/110 |
| 4,209,550 | 6/1980 | Hogenbach et al. | 430/108 |

FOREIGN PATENT DOCUMENTS

| | | | |
|---|---|---|---|
| 1233869 | 6/1971 | United Kingdom | 430/110 |

*Primary Examiner*—Joseph L. Schofer
*Assistant Examiner*—Peter F. Kulkosky
*Attorney, Agent, or Firm*—E. O. Palazzo

[57] ABSTRACT

Disclosed is the use of a novel diester as an additive to a toner, the ester being of the formula:

wherein R is of the formula being independently selected from the group consisting of phenyl, substituted phenyl, aliphatic and substituted aliphatic.

In one embodiment a toner containing this additive is used in a flash fusing system whereby it acts as a stabilizer thus eliminating decomposition of the toner. The additive can also be used to lower the toner melt viscosity and the fusing temperature of the toner.

12 Claims, 1 Drawing Figure

EFFECT OF FLASH FUSING STABILIZERS
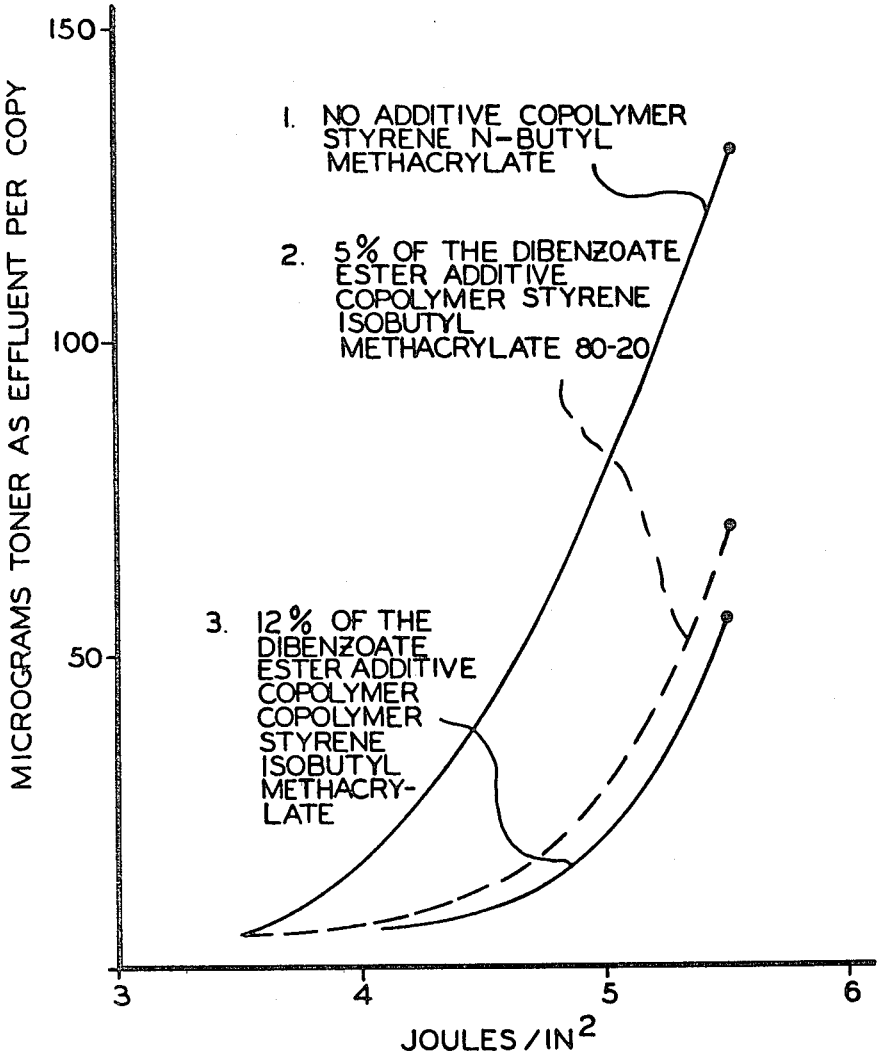

TONER ADDITIVES

This is a division, of application Ser. No. 958,911, filed, Nov. 8, 1978.

BACKGROUND OF THE INVENTION

This invention relates generally to a new composition of matter and more specifically to improved toner compositions for use in flash fusing in electrophotographic imaging processes.

The formation and development of images on the surface of electrophotographic materials by electrostatic means is well known and basically involves subjecting a xerographic plate comprising a conductive backing upon which is placed a photoconductive insulating surface to a uniform charge and subsequently exposing the photoconductive surface to a light image of the original to be reproduced. The photoconductive surface is prepared in such a manner so as to cause it to become conductive under the influence of the light image in order that the electrostatic charge formed thereon can be selectively dissipated to produce what is developed by means of a variety of pigmented resin materials specifically made for this purpose such as toner. The toner material is electrostatically attracted to the latent image areas on the plate in proportion to the charge concentration contained thereon thus areas of high charge of concentration become areas of high toner density and correspondingly low charge images become proportionally less dense. Thereafter the developed image is transferred to a final support material such as paper and affixed thereto for a permanent record or copy of the original.

Numerous methods are known for applying the electroscopic particles to the electrostatic latent image to be developed, such as for example cascade development as described in U.S. Pat. No. 2,618,552; magnetic brush as described in U.S. Pat. Nos. 2,874,063; 3,251,706; and 3,347,402; powder cloud development as disclosed in U.S. Pat. No. 2,217,776; and touchdown development as described in U.S. Pat. No. 3,166,432.

The image can be fixed by a number of various well known techniques including for example vapor fixing, heat fixing, pressure fixing or combinations thereof as described for example in U.S. Pat. No. 3,539,161. These techniques of fixing do suffer from some deficiencies thereby rendering their use either impractical or difficult for certain electrophotographic applications. It has been found for example rather difficult to construct an entirely satisfactory heat fuser which has high efficiency, ease of control and short warm-up time. Also heat fusers sometimes burn or scorch the support material, for example the paper. Somewhat similar problems exist with pressure fixing methods whether used with heat or without heat and more particularly such problems include for example image offsetting, resolution degradation, and further additionally there cannot be consistently produced a good permanent type of fix. Vapor fixing has several advantages but one of its main problems is that the toxic solvent that is used in many cases makes such a method commercially unattractive because of the health hazards and pollution control standards involved. For example equipment and apparatus to sufficiently isolate the fuser from the surrounding air is very complex, costly, difficult to operate and thus it is difficult to obtain consistent results in such situations.

Many of the modern electrostatographic reproducing apparatus resulted in the development of new materials and new processing techniques, one such apparatus being an automatic electrostatographic reproducing apparatus which is capable of producing copies at an extremely rapid rate. In such situations it appears that the best method for fixing is radiant flash fusing, one of the main advantages of such a technique being the energy which is emitted in the form of electromagnetic waves is available immediately and requires no intervening medium for its propagation. However, although an extremely rapid transfer of energy between the source and the receiving body is provided when using the flash fusing process, a problem encountered with such a system is obtaining an apparatus which can fully and efficiently utilize a preponderance of the radiant energy emitted by the source during a relatively short flash. The toner image usually comprises a relatively small percentage of the total area of the copy receiving the radiant energy and in view of this the properties of most copying materials as for example paper, causes most of the energy to be wasted as it is transmitted to the copy or is reflected away from the fusing area.

Additionally, when radiant energy from the flash fuser is generated at high levels which is necessary in order to fuser the toner, objectionable odor and smoke results in some instances because of the thermal decomposition of the base resin at the temperature at which fusing must occur. Further additives have been employed in the prior art in an attempt to eliminate such decomposition but this has not been successful and further in many instances the additives being used decompose under the process conditions of development.

The flash energy used in a flash fusible toner system is absorbed in a layer of toner of finite thickness adjoining the outer toner surface with the absorption being greatest at the surface and constantly decreasing with increasing distance from the outer surface. The flash is of very short duration on the order of about 1 millisecond and consequently the toner very close to the surface is heated to a much higher temperature than the toner mass as a whole, thus in view of the higher temperature the majority of the decomposition that occurs takes place very close to the toner surface. Additionally, the volatile material that is formed cannot be absorbed or entrapped by the decomposed toner matrix and thus it escapes from the toner layer before the toner cools appreciably. Thus the volatile decomposition products formed close to the surface have a much higher probability of escaping as effluents than do those formed deep inside the toner layer. This, together with the greater decomposition close to the surface as compared to the decomposition occuring inside the toner mass, causes the undesirable decomposition products to arise almost entirely in a very thin layer of toner next to the surface. Thus there is need for a material that will eliminate and/or substantially control this decomposition while at the same time being compatible with the toner composition itself, such additive not effecting the system in any other adverse manner. Such an additive should also be able to withstand decomposition itself.

At the same time there is a need for materials such as plasticizers which lower the viscosity of the toner resin, are nonvolatile and thermally stable. It is well known that toner is subjected to mechanical attrition which tends to break down the particles into undesirable dust fines and such fines are detrimental to machine operation in that they are extremely difficult to remove from reusable imaging surfaces and also because they tend to drift to other parts of the machine and deposit on critical machine parts such as optical lenses. The formation of these fines is reduced somewhat when the toner contains a tough high molecular weight resin which is capable of withstanding the shear and impact forces imparted to the toner during the development process. However, unfortunately many high molecular weight materials cannot be employed in high speed automatic machines as they cannot be rapidly fused during a powder image heat fixing step. In order to avoid combustion additional equipment such as complex and expensive cooling units are necessary to properly eliminate the large quantity of heat generated in the fuser. For this reason it is important to lower the point at which the toner flows so that less energy can be used to cause it to perform properly.

BRIEF DESCRIPTION OF THE DRAWING

FIG. 1 is a graphical representation illustrating the amount of toner in micrograms that is emitted when no additive is present, compared to the amount of toner emitted when various percentages of the additive isopropylidene diphenoxy dibenzoate ester are present.

SUMMARY OF THE INVENTION

It is therefore an object of this invention to provide toners which overcome the above-noted disadvantages.

It is a further object of this invention to provide a new composition which is useful in toners employed in a flash fusing environment.

Another object of the present invention is to provide toner materials which contain compatible additives that are effective as plasticizers and are also effective in reducing the rate of thermal decomposition of the base resin.

Another object of this invention is the preparation of toners which lower the toner melt viscosity and thus the fusing temperature.

Still another object of this invention is to provide a composition which serves both as a plasticizer and as a stabilizer for eliminating decomposition, thus preventing emission of objectionable odors during flash fusing of toners.

Another object of the present invention is to provide a composition which does not itself adversely affect the developer, is thermally stable and does not decompose under flash fusing conditions.

It is yet another object to produce a toner which has a dual function that is it reduces the rate of thermal decomposition of the base resin and at the same time lowers the toner melt viscosity and fusing temperature.

These and other objects of the present invention are accomplished by providing a new composition and employing such composition as an electrophotographic flash fusable toner material, this composition being a diester as embraced by the following formula:

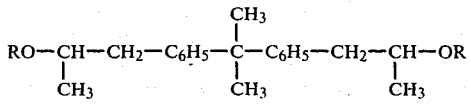

Wherein R is of the formula

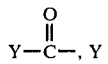

being independently selected from the group consisting of phenyl, substituted phenyl, aliphatic, and substituted aliphatic. Examples of aliphatic groupings include those containing from 1 to about 6 carbon atoms such as methyl, ethyl, propyl, isopropyl, butyl, n-butyl, hexyl and the like. Examples of substituents for the substituted phenyls and substituted aliphatics include halogens such as chloro, bromo and fluoro substituents. One preferred ester is isopropylidere diphenoxy dibenzoate ester.

The diesters which can be used as a toner additive, the toner being comprised of a resin and pigment are themselves thermally stable, that is, they do not adversely affect the development system and more specifically, do not decompose or oxidize under high temperatures used in fusing and in particular flash fusing systems. Further the diesters function as plasticizers and substantially eliminate the decomposition of the toner resin at its surface during a flash fusing process. In one embodiment the diesters mentioned herein function in a dual capacity that is they not only reduce the rate of thermal decomposition of the base resin used in the toner, but simultaneously act as plasticizers in that they lower the toner melt viscosity and fusing temperatures In one embodiment the diesters of the present invention can be prepared by reacting isopropylidene diphenoxy isopropyl alcohol with esters such as methylbenzoate whereby a transesterification occurs, followed by removal of the residual alkyl benzoate by heating under vacuum. One specific method for obtaining a dibenzoate ester of the present invention involves a transesterification reaction wherein for example 1 part of isopropylidene diphenoxy isopropyl alcohol, 2 parts of methyl benzoate, and 1000 parts per million of lead acetate catalyst are reacted by placing these ingredients in a one liter resin kettle equipped with a paddle wheel stirrer, a Dean stark separator and an Argon sparge. With the reactants stirred and the Argon sparge on, heat was applied until the reaction mixture reached 200° C. at which point methyl alcohol was collected in the Dean stark trap. The temperature was maintained at 200° C. until almost two moles of methyl alcohol were collected. The reaction mixture was then placed under a vacuum to collect any unreacted methyl benzoate. The pressure was reduced to 0.1 Torr and the temperature raised to 220° C. for approximately six hours. The reaction product (i.e., the dibenzoate ester) was analyzed by Gel Permeation Chromatography and Infrared for purity and found to contain be about 98% pure. About 2 percent monobenzoate ester was the remaining product.

Similar methods can be used to make other diesters of the present invention.

The diesters of the present invention should be very compatible with the toner resin, that is a continuous phase is formed when both of the materials are mixed, which allows the viscosity of the toner to be lowered and provides excellent penetration of the toner into the substrate material such as paper, thus providing higher quality images. The additive is blended internally with the polymer to form the toner composition. The amount of diester used can vary over wide ranges depending on many factors including the resin used in the toner, and the degree of stabilization or plasticization desired.

Generally from about 3 percent to about 10 percent of additive by weight of toner, is used for stabilization, while from about 2 percent to about 20 percent and preferably from about 5 percent to about 15 percent of additive by weight of toner is used for plasticizing purposes. The glass transition temperature $T_g$ of the preferred additive namely isoproplyidene diphenoxy dibenzoate ester is 4.5 degrees centigrade.

Any suitable resin material may be used for the toner compositions of the present invention. Substantially transparent resins are preferred when the toner is to be used in a color electrophotographic system. Although any substantially transparent resin material may be utilized as the resin component of this toner, it is preferable that resins having other desirable properties be utilized in this invention. Thus, for example, it is desirable that a resin be used which is a non-tacky solid at room temperature so as to facilitate handling and use in the most common electrophotographic processes. Thermoplastics are desirable with softening points significantly above room temperature, but below that of which ordinary paper tends to char so that once the toner images form thereon or transfer to a paper copy sheet it may be fused in place by subjecting it to heat. The resins selected should desirably have good triboelectric properties and have sufficient insulating properties to hold charge so that they may be employed in a number of development systems.

While any suitable resin possessing the properties as above described may be employed in the system of the present invention, particularly good results are obtained with the use of vinyl resins and aromatic polyesterification products of a dicarboxylic acid and a diol. Many suitable vinyl resin may be employed in the toners of the present system including homopolymers or copolymers of two or more vinyl monomers. Typical of such vinyl monomeric units include: styrene; p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; vinyl ethers such as vinyl methyl ether, vinyl isobutyl ether, vinyl ethyl ether and the like; vinyl ketones such as vinyl methyl ketone, vinyl kexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof.

It is generally found that toner resins containing a relatively high percentage or sytrene are preferred since greater image definition and density is obtained with their use. The styrene resin employed may be a homopolymer of styrene or styrene homologs or copolymers of styrene with the other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization processes such as free radical, anionic and cationic polymerization processes. Any of these vinyl resins may be blended with one or more other resins if desired, preferably other vinyl resins which insure good triboelectric stability and uniform resistance against physical degradation. However, non-vinyl type thermoplastic resins may also be employed including resin modified phenol formaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the present invention. The diphenol reactant has the general formula:

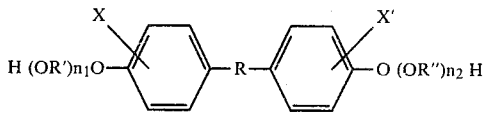

wherein R can be substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' are substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R is an alkylidene radical having from 2 to 4 carbon atoms and R' and R'' represents an alkylene radical having from 3 to 4 carbon atoms and preferred because greater blocking resistance, increased definition of xerographic characters and more complete transfer of toner images are achieved. Optimum results are obtained with diols in which R is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on resuable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy propoxy-phenyl)-propane, 2,2-bis(4-hydroxy-propoxy-phenyl) propane, 1,1-bis(4-hydroxy-ethoxy-phenyl)-butane, 1,1-bis(4-hydroxy-isopropoxy-phenyl) heptane, 2,2-bis(3-methyl-4-beta-hydroxy ethoxyphenyl) propane, 1,1-bis(4-beta hydroxy ethoxy phenyl)-cyclohexane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R′ and R″ represent an alkylene radical having from 3 to 4 carbon atoms are preferred because greater blocking resistance, increased definition of xerographic characters and more complete transfer of toner images are achieved. Optimum results are obtained with diols in which R is isopropylidene and R′ and R″ are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol disclosed herein to form the toner compositions of this invention either substituted or unsubstituted, saturated or unsaturated, having the general formula:

HOOC R‴COOH wherein R‴ is a substituted or unsubstituted alkylene radical having from 1 to 12 carbon atoms, arylene radicals or alkylene arylene radicals having from 10 to 12 carbon atoms. Examples of such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, isophthalic acid, terephthalic acid, o-phenyleneacetic-beta-propionic acid, itaconic acid, maleic acid, maleic acid anhydride, fumaric acid, phthalic acid anhydride, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be blended with one or more other thermoplastic resins, preferably aromatic resins, aliphatic resins, or mixtures thereof. Typical thermoplastic resins include: resin modified phenol formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperature is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin additive blend is substantially homogeneous and highly compatible. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re. 25,136 to Carlson and polystyrene blends as described in U.S. Pat. No. 2,788,288 to Rheinfrank and Jones.

Where carrier materials are employed with the toner compositions of the present invention in cascade and magnetic brush development, the carrier particles employed may be electrically conductive, insulating, magnetic or non-magnetic, as long as the carrier particles are capable of triboelectrically obtaining a charge of opposite polarity to that of the toner particles so that the toner particles adhere to and surround the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include: sodium chloride, ammonium chloride, aluminum potassium chloride, Rochelle salt, sodium nitrate, aluminum ritrate, potassium chlorate, granular zircon, granular silicon, methyl methacrylate, glass, steel, nickel, iron, ferrites, ferromagnetic materials, silicon dioxide and the like. The carriers may be employed with or without a coating. Many of the foregoing and typical carriers are disclosed in U.S. Pat. Nos. 2,618,441; 2,638,416; 2,618,522; 3,591,503; and 3,533,835 directed to electrically conductive carrier coatings, and U.S. Pat. No. 3,526,533 directed to methyl terpolymer coated carriers which are the reaction products or organo silanes, silanols or siloxanes with unsaturated polymerizable organic compounds (optimum among those disclosed are terpolymer coatings achieved with a terpolymer formed from the addition polymerization reaction between monomers or prepolymers of: styrene, methylmethacrylate and unsaturated organo silanes, silanols or siloxanes); and nickel berry carriers as disclosed in U.S. Pat. Nos. 3,847,604 and 3,767,598. Nickel berry carriers are nodular carrier beads of nickel characterized by a surface of recurring recesses and protrusions giving the particles a relatively large external surface area. An ultimate coated carrier particle diameter between about 50 microns to about 1000 microns is preferred because the carrier particles then possess sufficient density and inertia to avoid adherence to the electrostatic images during the cascade development process. The carrier may be employed with the toner composition in any suitable combination, generally satisfactory results have been obtained when about 1 part toner is used with about 10 to about 200 parts by weight of carrier.

The toners of the present invention also may be utilized in systems such as powder cloud development which do not require any carrier.

Any suitable pigment or dye may be employed as the colorant for the toner particles. Toner colorants are well known and include, for example, carbon black, nigrosine dye, aniline blue, Calco Oil Blue, chrome yellow, ultramarine blue, Du Pont Oil Red, Quinoline Yellow, methylene blue chloride, phthalocyanine blue, Malachite green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of typed documents are desired, the toner may comprise a black pigment such as carbon black or a black dye such as Amaplast Black dye, available from the National Aniline Products, Inc. Preferably, the pigment is employed in an amount from about 3 percent to about 20 percent by weight, based on the total weight of the colored toner. If the toner colorant employed is a dye, substantially smaller quantities of colorant may be used. The pigment or dye should be stable up to about 300° C. and they should not decompose when used in flash fusing systems.

The toner compositions of the present invention may be prepared by any well known toner mixing and combination technique. For example, the ingredients may be thoroughly mixed by blending, mixing and milling the components and thereafter micropulverizing the resulting mixture. Another well known technique for forming toner particles is to spray-dry a ball-milled toner composition comprising a colorant, a resin and a solvent.

The toner compositions of the present invention including the diester additives may be used to develop electrostatic latent images on any suitable electrostatic surface capable of retaining charge including conventional photoconductors. The photoconductive layer may comprise an inorganic or an organic photoconductive material. Typical inorganic materials include: sulfur, selenium, zinc sulfide, zinc oxide, zinc cadmium sulfide, zinc magnesium oxide, cadmium selenide, zinc silicate, calcium strontium sulfide, cadmium sulfide, 4-dimethylaminobenzylidene benzhydraside; 3-benzylidene-amino-carbazole, polyvinyl carbazole; (2-nitrobenzylidene)-p-bromo-aniline; 2,4-diphenylquinazoline; 1,2,4-triazine; 1,5-diphenyl-3-methyl pyrazoline 2-(4'-dimethylamino phenyl)-benzoxazole; 3-amino-carbazole; polyvinyl carbazole-trinitrofluorenone charge transfer comples; phthalocyanines and mixtures thereof.

The flash fusing system for use in the fusing process utilizing the toner of the present invention may be any of the known flash fusers such as disclosed in U.S. Pat. Nos. 3,529,129; 3,903,394; and 3,474,223. A flash fuser generally utilizes a Xenon flash lamp. The output of the lamp is primarily in the visible and near infrared wavelengths. The output of the flash lamp is measured by joules using the capacitor bank energy in accordance with the formula $\frac{1}{2}CV^2$ wherein C is capacitance and V is voltage. One of the main advantages of the flash fuser over other known methods of fusing is that the energy propagated in the form of electromagnetic waves is immediately available and no intervening source is needed for its propagation. Also flash fusing systems do not require long warm up periods, and the energy does not have to be transferred through a relatively slow conductive or corrective heat transfer mechanism.

As the graph of FIG. 1 indicates, at 5.5 Joules/in$^2$ absorbed energy, about 130 micrograms per copy is emitted as undesirable effluent when no additive is employed with the toner, reference line 1, which is the copolymer resin styrene n-butyl methacrylate 65/35 while the amount of effluent emitted per copy with a dibenzoate additive (isopropylidene diphenoxy dibenzoate ester) is substantially lower, for example, with 5 percent of dibenzoate added to a toner comprised of a copolymer of styrene/isobutyl methacrylate (80/20) only 70 micrograms per copy of undesirable effluent emitted, reference line 2. Similarly when 12 percent of the dibenzoate was added to the same toner only 55 micrograms per copy of undesirable effluent is emitted, reference line 3. Therefore, the data on this graph establishes that the use of dibenzoate esters with various toners decreases significantly the amount of effluents emitted.

The following examples are being supplied to further define the specifics of the present invention, it being noted that these examples are intended to illustrate and not limit the scope of the invention. Parts and percentages are by weight unless otherwise indicated.

EXAMPLES I-IX

It is important that the additive used such as the dibenzoate esters not only substantially eliminate undesirable effluents but such additive should not adversely effect the other desirable properties of the toner and thus the resulting image. Thus the additive should be compatible with the toner resin, should not effect its triboelectric properties, and most importantly should allow the toner to sufficiently penetrate the copy substrate such as paper so that the image becomes well adhered to the paper or other suitable substrate. The data presented in Table I indicates that a base resin composed of 91 percent of a 65/35 copolymer of styrene-n-butyl mechacrylate, and 9 percent of the carbon Black Mogul L, no additive that there is a 12 percent decrease in solid area density during the first five cycles on a Tabor Abrader with a 1 kilogram weight, while when two percent of the additive dibenzoate ester, isoproplyidene diphenoxy dibenzoate ester is added to the same toner comprised of 89 percent resin and 9 percent carbon black only a 9 percent decrease in solid area density results indicating an improvement in adhesion. The toners shown in Table I were flash fused at 7.5 Joules/in$^2$ stored energy or 4 Joules/in$^2$ absorbed energy.

When 5 percent of the same dibenzoate additive is used with the same toner, (86% resin, 9 percent carbon black) only a 7 percent decrease in solid area density results indicating a further improvement of adhesion.

Similar results are shown when the same dibenzoate additive is used together with other toners, for example 10 percent additive, 80 percent resin, 10 percent carbon black, results in a 4 percent decrease in solid area density, while with 70 percent resin, 10 percent carbon black, 10 percent Kraton 4119 styrene butadiene copolymer, a reinforcing additive commercially available, only a 1 percent decrease in solid area density noted; as compared to an 18 percent decrease in solid area density with the same toner, 90 percent of an 80/20 copolymer of styrene/isobutyl methacrylate 10 percent carbon black and no additive.

The results are even more significant when compared to a 34 percent decrease in image density when a toner comprised of 70 percent of 80/20 styrene/isobutyl methacrylate and 20 percent of pentaerythritol tetrabenzoate, a plasticizer, 1.5 percent zinc stearate, and 10 percent carbon black is used. Thus 34 percent of the image is lost indicating poor penetration of the toner to the paper.

TABLE 1

| Example No. | Base Toner Resin | Additive | Pigment-Carbon Black | Particle Size Vol. Average Micrometer | % Decrease in Solid Area Density |
|---|---|---|---|---|---|
| 1 | 91% copolymer of styrene n-butyl methacrylate (65/35) | | 9% Mogul L | 13.6 | 12 |
| 2 | 89% copolymer of styrene n-butyl methacrylate (65/35) | | 9% Mogul L | | 28 |
| 3 | 86% copolymer of styrene n-butyl methacrylate (65/35) | | 9% Mogul L | 15.3 | 30 |
| 4 | 89% copolymer of stryene n-butyl methacrylate (65/35) | 2% dibenzoate ester | 9% Mogul L | 12.9 | 9 |
| 5 | 89% copolymer of styrene n-butyl methacrylate (65/35) | 5% dibenzoate ester | 9% Mogul L | 15.8 | 7 |
| 6 | 90% copolymer of styrene isobutyl methacrylate (80/20) | | 10% Mogul L | 16.5 | 18 |
| 7 | 80% copolymer of styrene isobutyl methacrylate (80/20) | 10% dibenzoate ester and 10% Kraton 4119 Reinforcing Agent | 10% Mogul L | 15.9 | 4 |
| 8 | 70% copolymer of styrene isobutyl methacrylate (80/20) | 10% dibenzoate ester | 10% Mogul L | 14.0 | 1 |
| 9 | 70% copolymer of styrene isobutyl methacrylate (80/20) | 20% Pentraerythritol tetrabenzoate, 1.5% Zinc Stearate | 10% Black Pearls L | | 34 |

*Note these toners were flash fused at 7.5 Joules/in$^2$ stored energy or 4 Joules/in$^2$ absorbed energy.

EXAMPLE X

The procedure of Examples I–IX was repeated using in addition to the toner and dibenzoate ester additive a 250 micron steel shot carrier coated with styrene methylmethacrylate copolymer. An electrostatic latent image is developed with this material resulting in a toner image that corresponds to the latent image. The powder image is then transferred to paper and permanently affixed thereto by flash fusing. When no additive is present images of low resolution resulted and objectionable smoking and odor was detected as compared with images of high resolution and no smoking or odor being detected when an additive is present.

EXAMPLE XI

The procedure of Example X is repeated, however, both the toner with additive and the toner without additive were flash fused at about 200° C. It is observed that the toner with additive had a better fix as compared to the toner without additive as determined by Taber Abrasion testing and by measuring the optical density subsequent to flash fusing of the toner with additive and without additive. The toner with additive is of higher optical density indicating a better fix and toner flow than the toner without additive.

Other modifications of the present invention will occur to those skilled in the art upon reading of the present disclosure. These are intended to be included within the scope of this invention.

What we claim is:

1. A toner composition for use in flash fusing electrophotographic imaging systems comprised of a resin and an additive of a diester of the formula:

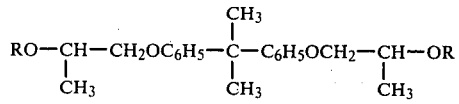

wherein R is of the formula

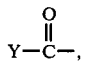

Y being independently selected from the group consisting of phenyl, substituted phenyl, aliphatic, and substituted aliphatic.

2. A toner composition in accordance with claim 1 wherein Y is phenyl.

3. A toner composition in accordance with claim 1 wherein Y is methyl.

4. A toner composition in accordance with claim 1 wherein Y is isopropyl.

5. A toner in accordance with claim 1 wherein the resin is styrene n-butylmethacrylate.

6. A toner in accordance with claim 1 wherein the resin is a polyester material.

7. A toner in accordance with claim 1 wherein the resin is styrene isobutylmethacrylate.

8. A toner in accordance with claim 1 wherein the amount of additive present is between 3 percent and 10 percent based on the weight of toner.

9. A toner in accordance with claim 1 wherein a carrier material is added to the composition.

10. A toner in accordance with claim 9 wherein the carrier material is steel and is coated with a styrene methylmethacrylate copolymer.

11. A toner in accordance with claim 1 wherein the benzoate ester acts as a plasticizer whereby the melt viscosity of the toner resin is significantly reduced.

12. A toner in accordance with claim 1 wherein the dibenzoate ester prevents decomposition of the toner.

* * * * *